US006123654A

United States Patent [19]

LaFleur

[11] Patent Number: 6,123,654

[45] **Date of Patent: *Sep. 26, 2000**

[54] BAG LINER LOADER

[75] Inventor: Lee LaFleur, Manistee, Mich.

[73] Assignee: Custom Packaging Systems, Inc., Manistee, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/003,624

[22] Filed: Jan. 7, 1998

[51] Int. Cl.[7] ..... B31B 1/90

[52] U.S. Cl. ..... 493/217; 493/294

[58] Field of Search ..... 493/217, 294, 493/933; 53/439, 309, 390, 449, 175

[56] References Cited

U.S. PATENT DOCUMENTS

| | | | |
|---|---|---|---|
| 545,365 | 8/1895 | Ingalls | 53/390 |
| 1,450,111 | 3/1923 | Parker | 53/390 |
| 2,135,132 | 11/1938 | Boehmer | 493/210 |
| 2,154,521 | 4/1939 | Maxfield | 53/449 |
| 2,555,585 | 6/1951 | Fairbank | 53/449 |
| 2,567,267 | 9/1951 | Andrews | 53/449 |
| 2,847,805 | 8/1958 | Robbins | 53/439 |
| 2,974,457 | 3/1961 | Saxton | 100/13 |
| 3,318,242 | 5/1967 | Griffith | 100/13 |
| 3,445,985 | 5/1969 | Manetta | 53/390 |
| 3,471,996 | 10/1969 | Kingham | 53/390 |
| 3,763,621 | 10/1973 | Klein et al. | 53/439 |
| 3,789,745 | 2/1974 | Leader | 493/217 |
| 3,803,991 | 4/1974 | Leader | 493/217 |
| 3,996,721 | 12/1976 | Mercer | 53/449 |
| 4,016,707 | 4/1977 | Puchosic | 53/449 |
| 4,621,482 | 11/1986 | Crevasse et al. | 53/439 |
| 4,734,956 | 4/1988 | Frey et al. | 493/294 |
| 4,946,291 | 8/1990 | Schnaars | 493/933 |
| 5,104,236 | 4/1992 | LaFleur . | |
| 5,421,140 | 6/1995 | Theriault | 100/13 |

*Primary Examiner*—Peter Vo
*Assistant Examiner*—Louis L Huynh
*Attorney, Agent, or Firm*—Reising, Ethington, Barnes, Kisselle, Learman & McCulloch, P.C.

[57] ABSTRACT

An apparatus for loading a liner into a container made of a flexible material has an elongate tube into which the liner is inserted with its free end extending slightly beyond the end of the tube and over and onto which the container is received whereby the free end of the liner is generally aligned with a corresponding end of the container such that an operator may grab the corresponding ends of the liner and container and generally simultaneously remove the container and liner from the tube so the liner is received interiorily and stretched out within the container. This process is relatively simple and can be accomplished by a single operator to reduce the cost and time needed to insert a liner into a container. The apparatus can be used with containers having a spout or access opening in one or both of a pair of opposed end walls.

10 Claims, 2 Drawing Sheets

BAG LINER LOADER

FIELD OF THE INVENTION

This invention relates to bulk containers and more particularly to a method and apparatus for loading a liner into a bulk bag made of a flexible material.

BACKGROUND OF THE INVENTION

Previously, many granular products and some liquids have been shipped and stored in large bulk bags which may contain as much as a ton or more of material. Some of these bulk bags are flexible and when empty can be folded to a generally flat condition. One such flexible bag is disclosed and claimed in U.S. Pat. No. 5,104,236.

These flexible bags have generally rectangular ends interconnected by generally rectangular sidewalls and when filled can be stacked one on top of another. For some applications the bags are made of a woven fabric and for other applications, a plastic film material. For some applications, and particularly for storing liquids, a bag of a water impervious plastic film material is received in and reinforced and protected by a bag of a woven fabric. Usually, these bags have a spout in one or both ends for filling and emptying the bags.

Because the bulk bags may contain as much as a ton or more of material, they are generally quite large. They are thus somewhat difficult to handle and the insertion of a bag or liner of a plastic film material into an outer bulk bag, to provide an interior liner for the fabric bulk bag, is labor intensive. Two people are usually required to insert a liner into a bulk bag with one person holding the bulk fabric bag and the other inserting and aligning the liner within the fabric bag. The process is inefficient, time consuming and costly.

SUMMARY OF THE INVENTION

An apparatus for loading a liner into a container bag made of a flexible material has an elongate tube into which the liner is inserted and over which the bag is received whereby one end of the liner extends slightly beyond the end of the tube and is generally aligned with the corresponding end of the bag such that an operator may grab the corresponding ends of the liner and bag and generally simultaneously remove the bag and liner from the tube so that the liner is received interiorily of and stretched out within the bag. This process is relatively simple and can be accomplished by a single operator to reduce the cost and time needed to insert a liner into a bag. The apparatus can be used with bags having a spout or access opening in one or both of a pair of opposed end walls.

Preferably, the liners are constructed to be complementarily shaped to the interior surfaces of the bag when expanded and are attached end-to-end on a roll to provide a substantially continuous supply of liners. Alternatively, the liners may comprise a roll of plastic tubing which has an interior diameter sufficient to enable the tubing to conform to the interior surfaces of the bag when expanded. In either case, the liners may be severed from the roll when inserted into the bag or discrete lengths of the liner material may be separated from the roll along perforated lines formed between adjacent liners. With a substantially continuous roll of liners, the next liner is drawn into the tube when a previous liner is removed therefrom. This enables a single operator to quickly and efficiently insert the liners into subsequent bags.

Objects, features and advantages of this invention include providing an apparatus to insert a liner into a bag made of a flexible material that enables a single operator to insert the liner into the bag, provides a substantially continuous supply of liners, substantially automatically aligns and draws a subsequent liner into the apparatus as a previous liner is removed therefrom, is faster and easier than previous methods of loading a liner into a bag, can be used to load a liner into a bag having access openings in one or both of a pair of opposed walls, is of relatively simple design and economical manufacture, is reliable, durable and has a long and useful life in service.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENTS

Figure 1:
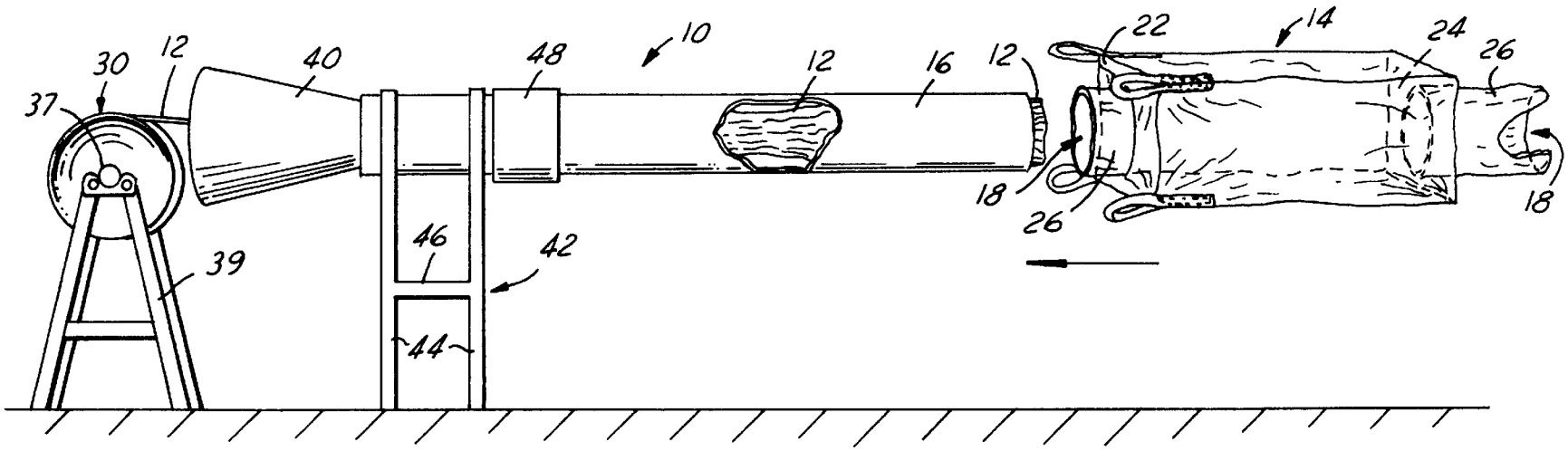
FIG. 1 is a side view of an apparatus for loading a liner into a flexible bulk bag embodying this invention.
Figure 3:
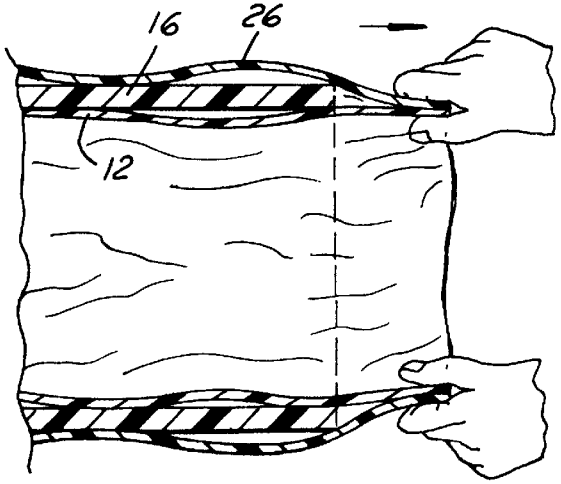
FIG. 3 is a partial sectional view illustrating an operator grasping the liner and bag to simultaneously remove them from the tube to load the liner into the bag.
Figure 2:
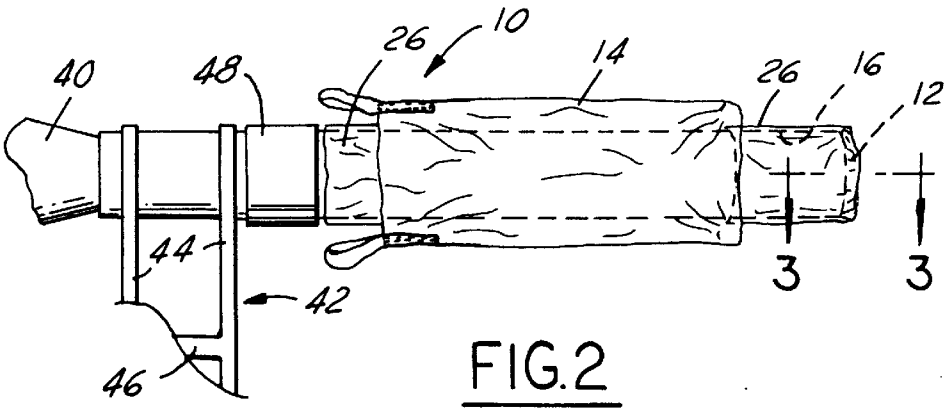
FIG. 2 is a fragmentary side view of the apparatus of FIG. 1 with a bulk bag having an access opening and spout in each of a pair of opposed end walls of the bag received on the tube of the apparatus.
Figure 4:
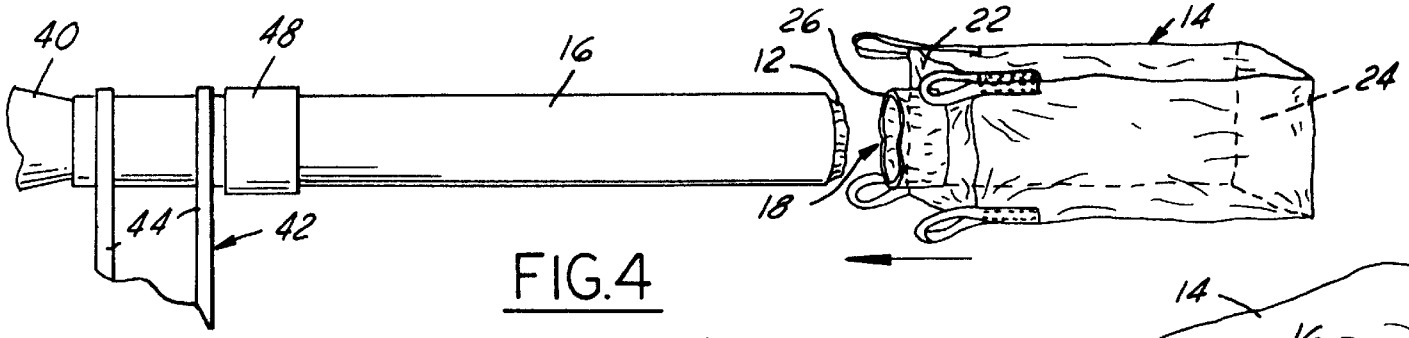
FIG. 4 is an exploded view illustrating a modified bulk bag having only one access opening positioned to be advanced onto the tube of the apparatus.
Figure 6:
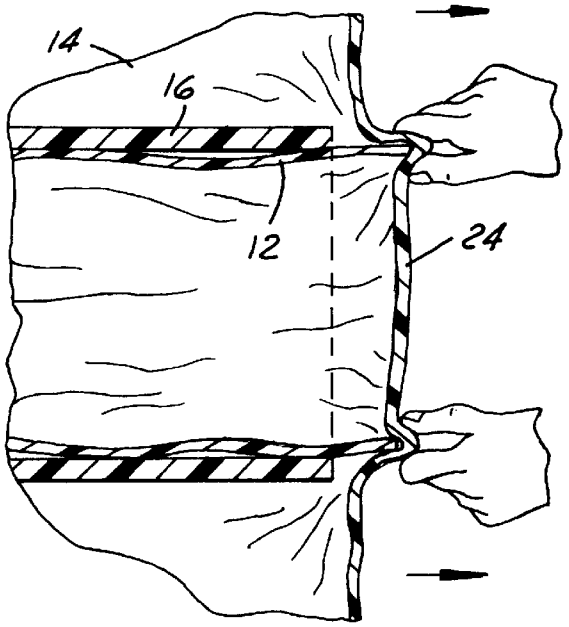
FIG. 6 is a partial sectional view illustrating an operator pinching the bottom wall of the bulk bag of FIG. 4 and the end of the liner together so the bag and liner may be simultaneously removed from the tube to load the liner into the bag.
Figure 5:
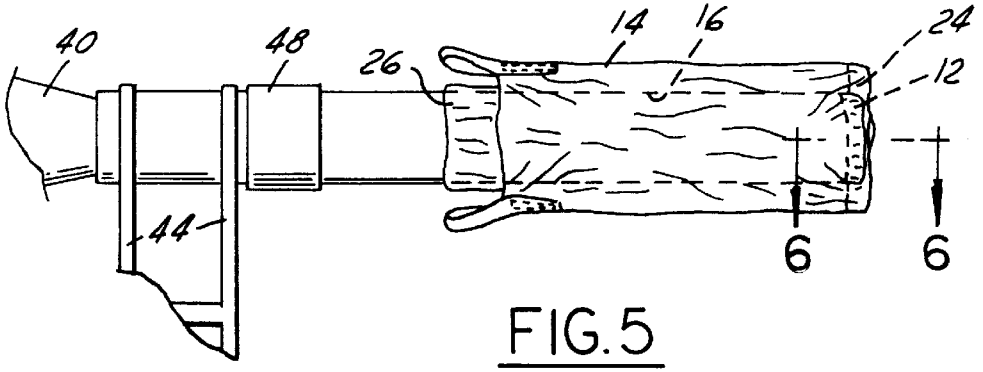
FIG. 5 is a fragmentary side view of the apparatus with the bulk bag of FIG. 4 received on the tube of the apparatus.

Referring in more detail to the drawings, FIGS. 1–3 show an apparatus 10 for loading a liner 12 into a container made of a flexible material, such as a bulk bag 14. The apparatus 10 has an elongate tube 16 into which the liner 12 is inserted and over which the bulk bag 14 is received through an access opening 18 in an end wall of the bag 14. A portion of the liner 12 extends slightly beyond the end of the tube 16 and is generally aligned with the corresponding end of the bulk bag 14 such that the corresponding ends of the liner 12 and bag 14 may be simultaneously pulled to remove the liner 12 and bulk bag 14 from the tube 16 with the liner 12 received interiorily of and stretched out within the bag 14. Preferably, the bulk bag 14 has opposed top and bottom walls 22, 24 and an access opening 18 and preferably a spout 26 in both its top and bottom walls 22, 24 to facilitate filling and emptying the bag 14 although the apparatus 10 can also be used with a bulk bag 14 having a spout 26 or just an access opening 18 in only one of its top and bottom walls 22, 24 (FIGS. 4–6). Preferably the bulk bags 14 when expanded having a generally cubical configuration, although they may be of substantially any configuration so long as at least one access opening 18 is provided into the interior of the bag 14 which permits the tube 16 to be received therein. Preferably, the bags 14 are of the type disclosed in U.S. Pat. No. 5,104,236, the disclosure of which is incorporated herein by reference and hence the bags 14 will not be described in greater detail.

Figure 7:
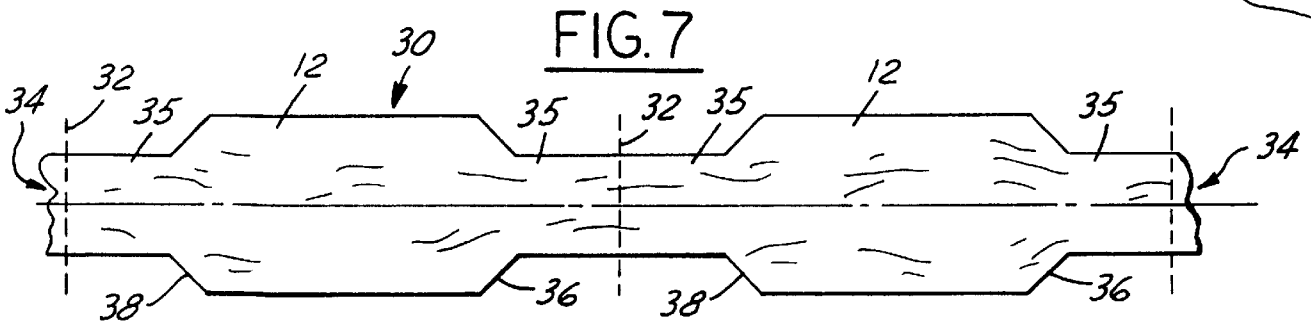
FIG. 7 is a plan view of several liners adapted to conform to the interior of a generally cubicle bulk bag when expanded and connected end-to-end such that they may be formed into a roll of liners.

As shown in FIG. 7, the liners 12 are preferably complementarily shaped to the bulk bags 14 to conform to the interior surfaces of the bulk bags 14 when expanded and are connected together in an end-to-end relationship so that they may be formed into a roll 30 of liners to be pulled through the tube 16 and inserted into the bags 14 one at a time. The liners are preferably formed of a plastic material substantially impervious to water such as polyethylene or polypropylene films and have walls generally about 2 mil. to 10 mil. thick. Perforated lines 32 formed between adjacent liners 12 facilitate removing a liner 12 from the roll 30 after it has been received within a bulk bag 14. The liners 12 have access openings 34 and spouts 35 therein in one or both of their top and bottom walls 36, 38 which are complementarily located and formed as those in the bulk bag 14. Preferably, when folded flat (as shown in FIG. 7), each liner has a first pair of opposed gusseted sidewalls folded and received between a second pair of opposed sidewalls. The preferred form of the liner 12 is disclosed in U.S. Pat. No. 5,104,236 the disclosure of which is incorporated herein by reference and hence the liner 12 will not be described in greater detail.

Alternatively, the liners 12 may comprise a roll 30 of flexible plastic tubing which has a diameter sufficient to enable the tubing to conform to the interior surfaces of the sidewalls of the bulk bag 14 when expanded. In either case, the liners 12 may be severed from the roll 30 after being inserted into the bag 14 or the liners may be separated from the roll along perforated lines 32 formed therein. The substantially continuous roll 30 of a plurality of liners aligns the next liner 12 or the next portion of liner material in the tube 16 as the previous liner 12 is removed therefrom so that liner 12 or that portion of the liner material is ready to be inserted into a subsequent bag 14.

The roll 30 of liners or liner material is preferably received on shaft 37 carried by a stand 39 to facilitate unrolling the material into the apparatus 10. The liner material is preferably initially received in a funnel 40 which directs the liners 12 into the tube 16 which is supported by and preferably fixed to a frame 42 having four spaced apart uprights 44 and various cross members 46 which support the uprights 44. Preferably the funnel 40 has in cross-section a generally oval shape with its major axis extending horizontally parallel to the plane of the liner as it is unrolled from the roll 30. A coupler 48 may be used to interconnect the funnel 40 and the tube 16.

The tube 16 is preferably between about 8–10 feet long to facilitate its use with a bulk bag 14 and liner 12 which are generally about 4 feet high when expanded and which can be 8 feet or more in length when collapsed and axially stretched. To facilitate movement of the liners 12 within the tube 16, the tube 16 preferably has an interior diameter of approximately 8 inches and is preferably formed of a plastic such as polyvinyl chloride (PVC) or the like having relatively smooth inner and outer surfaces to avoid snagging the liners or the bags.

Operation

In use, to begin feeding a roll 30 of liners 16 into the tube, the free end of the roll 30 is fed through the funnel 40 and a rope tied around the first liner may be fed through the tube 16 and used to pull the liners 12 through the tube 16 or an elongate stick or rod may be used to push the liners 12 through the tube 16 until the free end of the first liner extends beyond the open end of the tube 16 and is accessible by the operator. Preferably, to more easily receive the liners 12 in the tube 16 and to prevent the liners 12 from becoming twisted before or as they are loaded into a bag 14, the initial liner material is folded as desired by the operator, such as in thirds, before it is fed into the funnel 40. As additional liners 12 are pulled off of the roll 30, they will assume the folded configuration and remain essentially untwisted when advanced through the tube 16 and when loaded into a bag 14 to facilitate filling the liners 12 with the desired contents.

As shown in FIG. 2, a bulk bag 14 is placed over and onto the tube 16 with the tube 16 received through the access openings 18 in the top and bottom walls 22, 24 of the bag 14. This disposes one end 24 of the bag 14 adjacent the portion of the liner 12 extending beyond the open end of the tube 16 such that the operator may grab the end of the bag 14 and the corresponding end of the liner 12 at the same time, as shown in FIG. 3. The operator then pulls the bag 14 and liner 12 until they are removed from the tube 16 whereby the liner 12 is received interiorily of and stretched out within the bag 14. The operator then severs or detaches the liner 12 from the roll 30 such as by tearing along the perforated line 32 between that liner and the adjacent liner. If desired, the liner 12 may then be inflated within the bag 14 such as by supplying forced air into the interior of the liner 12 to conform the liner 12 with the interior surfaces of the bulk bag 14 or the air between the liner 12 and the bag 14 may be evacuated, such as by a vacuum, to draw the liner 12 towards the bag 14 and conform it to the interior surfaces of the bag 14. As a liner 12 is removed from the tube 16, the adjacent liner is pulled further into the tube 16 to position that liner so that it may be inserted into a subsequent bag 14.

Alternatively, as shown in FIGS. 4–6, a bulk bag 14 which has an access opening 18 in only its top wall 22 may be used. As shown in FIG. 5, the bag 14 is received on the tube 16 until its bottom wall 24 is adjacent to the free end of the tube 16. The operator then pinches the bottom wall 24 of the bag 14 and an adjacent portion of the liner 12 within the tube 16 together (FIG. 6) and removes the liner 12 and bag 14 simultaneously from the tube 16 with the liner 12 received interiorly of the bag 14.

The apparatus 10 enables a single operator to easily load and align a liner 12 into a bulk bag 14 to more efficiently load the liners 12 into the bags 14. Further, the apparatus 10 substantially automatically aligns the subsequent liners 12 within the apparatus 10 so that they may be readily inserted into subsequent bulk bags 14. Further, the apparatus 10 may be used with liners 12 and bags 14 of substantially any configuration as long as one suitable access opening 18 is provided in the bag 14.

What is claimed is:

1. An apparatus for loading a preformed empty interior liner enclosure of a flexible material having spaced apart ends, at least one sidewall extending between and interconnecting the ends and an opening in at least one end, into a preformed empty container made of a flexible material and having spaced apart ends, at least one sidewall extending between and enclosing the ends and an opening in at least one end, the apparatus comprising:

a stand alone device having an elongate tube means having a circumferentially continuous sidewall, having an open inlet end and an axially opposed open outlet end, the sidewall of the tube means having a length greater than the length of the uncompressed sidewall of the container, whereby the container is slid over the exterior of the sidewall of the tube means from the opening in one end of the container in such a way that the inlet end of the tube means is outside and spaced from the opening in the one end of the container and the outlet end of the tube means is inside and closely adjacent to the other end of the container;

the tube means having a circumference substantially less than the circumference of the sidewall of the liner, whereby the liner extending through the inlet end of the tube means and through the interior of the tube means with the one end of the liner adjacent the one end of the container adjacent the inlet end of the tube means and the other end of the liner extending through the outlet end of the tube means and immediately adjacent the other end of the container to permit gripping of both the container and the liner beyond the outlet end of the tube means to simultaneously pull both the container and the liner off the tube means; from the exterior of the tube means;

a funnel with a tapered sidewall having an inlet and an outlet, the outlet being substantially smaller than the inlet and substantially smaller than the circumference of the empty liner, the outlet of the funnel being adjacent to and aligned with the inlet of the tube means, and the funnel being constructed and arranged to fold the preformed liner upon itself as the liner is advanced through the funnel;

a stand for receiving a plurality of empty liners connected in end-to-end relationship and located adjacent the inlet end of the funnel for supplying empty liners through the funnel to the tube means;

a frame connected to the tube means adjacent only the inlet end of the tube means and beyond the container received on the exterior of the sidewall of the tube means, whereby the tube means with the container encircling the sidewall of the tube means and the liner in the sidewall of the tube means is carried by the frame; and the tube means being constructed for movement of each empty container generally longitudinally in one direction to receive the container over the exterior of the tube means and simultaneous movement of the container and the liner in the opposite direction to remove the container and the liner from the exterior and interior of the tube means, dispose the empty liner within and generally aligned with the empty container and draw an immediately succeeding preformed liner through the funnel to fold the succeeding preformed liner and draw the folded succeeding liner through the interior of the sidewall of the tube means and partially through the outlet end of the tube means all without filling the liner and bag with any contents.

2. The apparatus of claim 1 wherein the liner is one of a plurality of attached adjacent liners of a roll of liners to supply the apparatus with a substantially continuous supply of liners.

3. The apparatus of claim 2 wherein the stand carries a roll of liners with a free end of the roll of liners generally aligned with the tube means.

4. The apparatus of claim 1 wherein the container has an opening in each of a pair of opposed end walls and the sidewall of the tube means extends substantially completely through each opening.

5. The apparatus of claim 1 wherein the liner is formed of a flexible plastic material and is constructed and arranged to conform to the interior surfaces of the container.

6. The apparatus of claim 5 wherein the liner is complementarily shaped to the container when each is expanded.

7. The apparatus of claim 5 wherein the liner is generally tubular.

8. The apparatus of claim 1 wherein the funnel in cross-section is generally oval in shape with its major axis extending generally parallel to the plane of the liner as it enters the funnel and converges into the sidewall of the tube means to facilitate inserting the liner into the inlet end of the tube means.

9. The apparatus of claim 1 wherein the sidewall of the tube means is between about 6 feet to 12 feet in length.

10. The apparatus of claim 1 wherein the sidewall of the tube means has an inner diameter of approximately 6 inches to 12 inches.

* * * * *